US010919305B2

(12) United States Patent
Velez et al.

(10) Patent No.: US 10,919,305 B2
(45) Date of Patent: Feb. 16, 2021

(54) PRINTING AGENT CONTAINERS

(71) Applicant: HEWLETT-PACKARD DEVELOPMENT COMPANY, L.P., Spring, TX (US)

(72) Inventors: Eladia Velez, Aguadilla, PR (US); Carlos E. Rosario, Aguadilla, PR (US); Segi Gonzalez, Aguadilla, PR (US)

(73) Assignee: Hewlett-Packard Development Company, L.P., Spring, TX (US)

( * ) Notice: Subject to any disclaimer, the term of this patent is extended or adjusted under 35 U.S.C. 154(b) by 0 days.

(21) Appl. No.: 16/481,794

(22) PCT Filed: Jun. 19, 2017

(86) PCT No.: PCT/US2017/038175
§ 371 (c)(1),
(2) Date: Jul. 29, 2019

(87) PCT Pub. No.: WO2018/236338
PCT Pub. Date: Dec. 27, 2018

(65) Prior Publication Data

US 2019/0344575 A1 Nov. 14, 2019

(51) Int. Cl.
*B41J 2/175* (2006.01)

(52) U.S. Cl.
CPC ..... *B41J 2/17553* (2013.01); *B41J 2/17513* (2013.01)

(58) Field of Classification Search
CPC ..... B41J 2/17553; B41J 2/17513
See application file for complete search history.

(56) References Cited

U.S. PATENT DOCUMENTS

| | | | | |
|---|---|---|---|---|
| D346,331 | S | 4/1994 | Jaramillo | |
| 5,299,608 | A | 4/1994 | Bosyj | |
| 6,022,101 | A | 2/2000 | Sabonis | |
| 9,296,212 | B2 * | 3/2016 | Gonzalez | B41J 2/17509 |
| 9,597,881 | B2 | 3/2017 | Gonzalez | |
| 2010/0201761 | A1 | 8/2010 | Lu et al. | |
| 2010/0295905 | A1 | 11/2010 | Tamaki | |
| 2016/0236476 | A1 | 8/2016 | Gonzalez | |

FOREIGN PATENT DOCUMENTS

| | | | |
|---|---|---|---|
| FR | 2676022 | A1 | 11/1992 |
| JP | 2000103078 | A | 4/2000 |
| JP | 2003312002 | A | 11/2003 |
| WO | WO-8701677 | A1 | 3/1987 |
| WO | WO-2014046075 | A1 | 3/2014 |

* cited by examiner

*Primary Examiner* — Geoffrey S Mruk
(74) *Attorney, Agent, or Firm* — Fabian VanCott

(57) ABSTRACT

A printing agent container and a method for manufacturing printing agent containers is disclosed wherein the container has improved stability to external collision. The container comprises a receptacle having at least one side wall and a bottom surface defining an internal volume; a cap on a top surface of the receptacle; and a tube connected to the cap and defining a fluid connection between the internal volume and the cap, wherein the receptacle comprises a protrusion that is provided, at least partially, in the bottom surface, and that extends into the internal volume, defining a bottom feed region between the protrusion and a side wall and wherein the tube extends at least partially in the feed region.

20 Claims, 3 Drawing Sheets

PRINTING AGENT CONTAINERS

BACKGROUND

Printing agent containers are tanks that contain a volume of printing agent for printers. Large format agent containers are designed for large format printers and may contain relatively large volumes of printing agent, for example around ten liters of agent. Existing examples of large format agent containers may be arranged to be emptied into permanent agent containers in the large format printer. Other existing example agent containers are arranged to be fluidically connected to the printer and supply agent to the printer in a connected state. Such agent container may be located in the vicinity of the printer during usage, and connected to an agent inlet. The agent may be drawn from the agent container by a pump or other agent suction device, alternatively, the container may be pressurized as to allow agent to flow towards the printer.

Examples of printing agents may be inks, in the case of ink-based printing, or detailing and/or fusing agents in the case of 3D printers.

DETAILED DESCRIPTION

Printing agent containers, especially large format, may comprise moveable or flexible parts in the inner volume of the container. Examples of movable parts may be the tube for fluid connection between the inner volume of the container and a printer. It is beneficial for containers to comprise a receptacle wherein mechanisms for positioning and/or preventing the displacement of the moveable parts are provided. For example, when the moveable part is a tube, a collision on the container may cause the tube to move to an area away from the bottom surface so that part of the agent within the container may not be withdrawn from it. This is especially relevant in a printing agent container wherein the tube is, at least, partly flexible.

In one example, a printing agent container with increased stability to external vibrations and/or collisions is disclosed, although also other effects may be associated with different aspect of this disclosure.

In the foregoing, reference is made to the accompanying drawings. The examples in the description and drawings should be considered illustrative and are not to be considered as limiting to the specific example or element described. Multiple examples may be derived from the following description and/or drawings through modification, combination or variation of certain elements. Although certain features are shown and described in conjunction they may be applied separately to the ink tank of this description, also if not specifically claimed. Furthermore, it may be understood that examples or elements that are not literally described may be derived from the description and drawings by a person of ordinary skill in the art.

Figure 1:
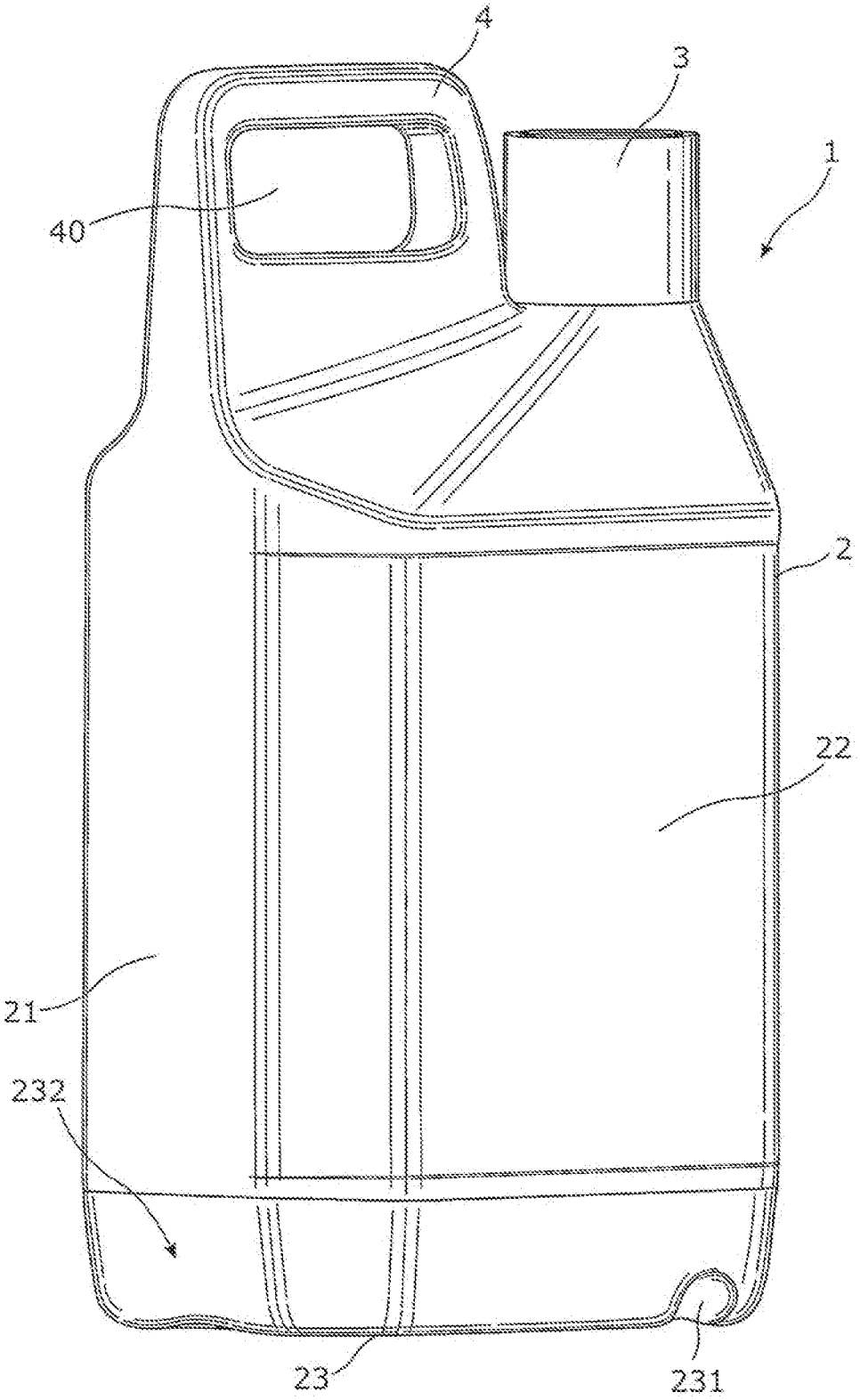
FIG. 1 shows a perspective view of a printing agent container.

FIG. 1 shows an example of printing agent container 1. In the example of FIG. 1, the container 1 comprises a receptacle 2 that may be a single cast thermoplastic receptacle 2 that includes a body for containing a printing agent and may be rigid or semi-rigid, i.e., the receptacle 2 may be arranged to at least approximately maintain shape without additional internal or external support structures, while holding at least approximately ten liters of ink. Additionally, the receptacle 2 may comprise a handle 4 with a though-hole 40. The handle 4 may be manufactured integrally to the receptacle, for example, by blow-molding. In the example of FIG. 1, a cap 3 is provided wherein, in assembled condition, the cap 3 is affixed to the body. The body of the receptacle 2 may comprise an opening for filling the receptacle 2 with agent. The body may comprise a neck that defines the opening. The cap 3 may be attached, e.g., screwed or otherwise fixed, to the neck.

The receptacle 2 may comprise at least one side wall and a bottom surface 23 which depending on their distribution may define different shapes, such as cylindrical, rectangular or, as in the case of FIG. 1, substantially polyhedral. In an example, a set of side walls comprise a pair of frontal faces 22 and a pair of lateral faces 21. The side walls 21, 22 and bottom surface 23 may be connected to each other through rounded corners 232.

Also, the protrusion 231 may be located, at least partially, on the bottom surface 23 and protrudes upwards into the inner volume of the receptacle 2. In one example the protrusion may also partly extend through a rounded corner edge between a side wall 22 and the bottom surface 23, and/or at least partly in the side wall 22. One function of this protrusion 231 is to provide support as to position a moveable part inside the receptacle 2 wherein in one example the movable part is a flexible or movable tube.

Figure 2:
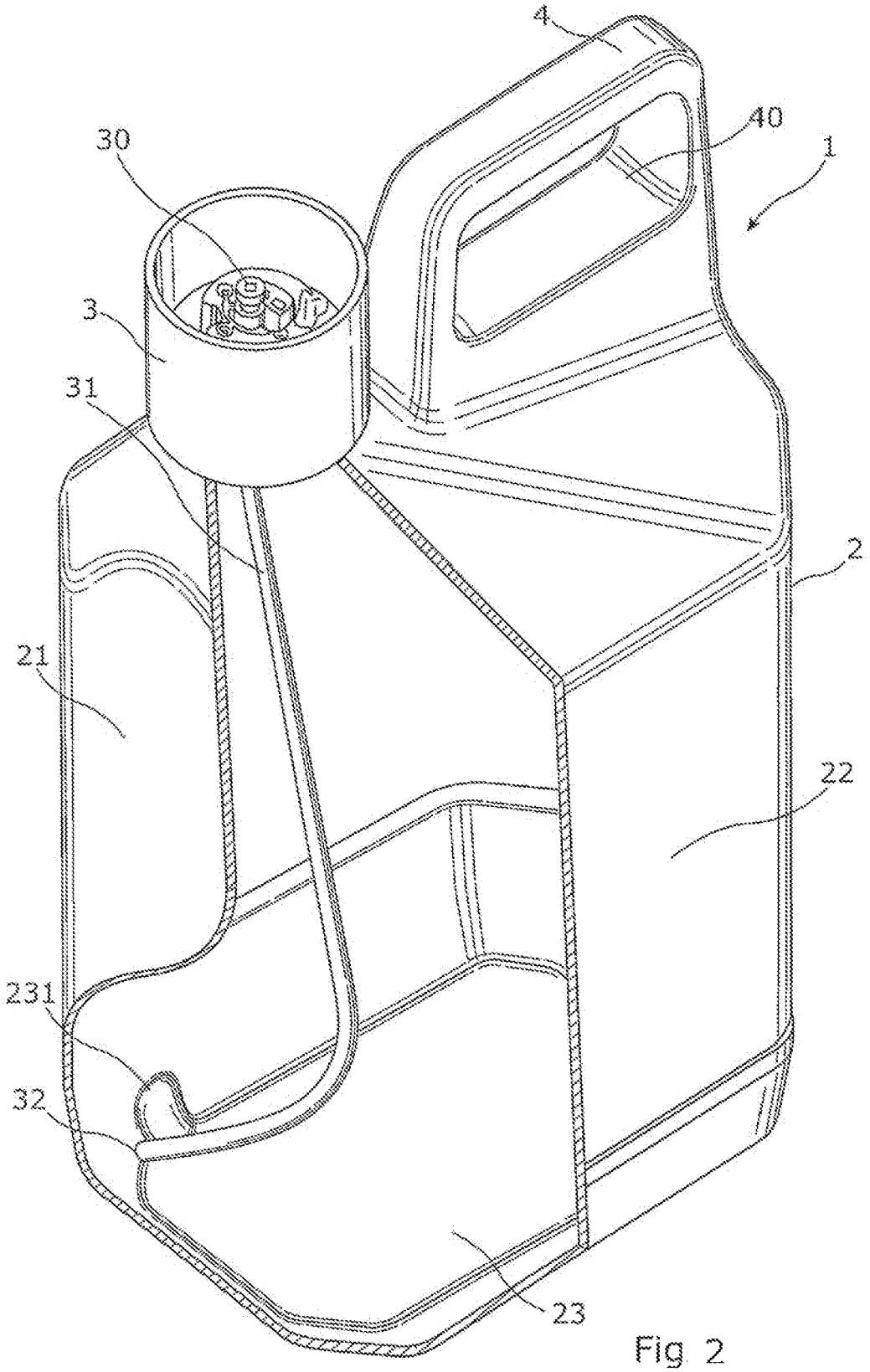
FIG. 2 shows a partial cut of a longitudinal section of an example of printing agent container.

FIG. 2 shows a partial longitudinal cut on the receptacle 2. It is further shown the tube 31 that is fluidically connected to the outlet 30. The tube 31 comprises a proximal end connected to the outlet 30 and a distal end 32 that is open to the inner volume of the receptacle 2. The tube 31 establishes a fluid connection between the inner volume of the receptacle 2 and an external device through the outlet 30 thereby allowing for the transfer of printing agent from the container 1, for example, to a printer.

For example, the tube 31 is at least partly flexible for bending and repositioning and may be partly rigid for maintaining a certain orientation or shape. For example, the tube includes only plastic material and is held in place between cap and bottom (as shown). In an example, the tube 6 has a slightly bended shape and may be dimensioned as to touch the bottom surface 23, i.e., with a height above the height of the container 1. In a further example, the distal end 32 is kept in contact with the bottom surface 23 using the force generated from bending it between the cap 3 on one end and the bottom surface 23 of the receptacle 2 on the other end.

Figure 3:
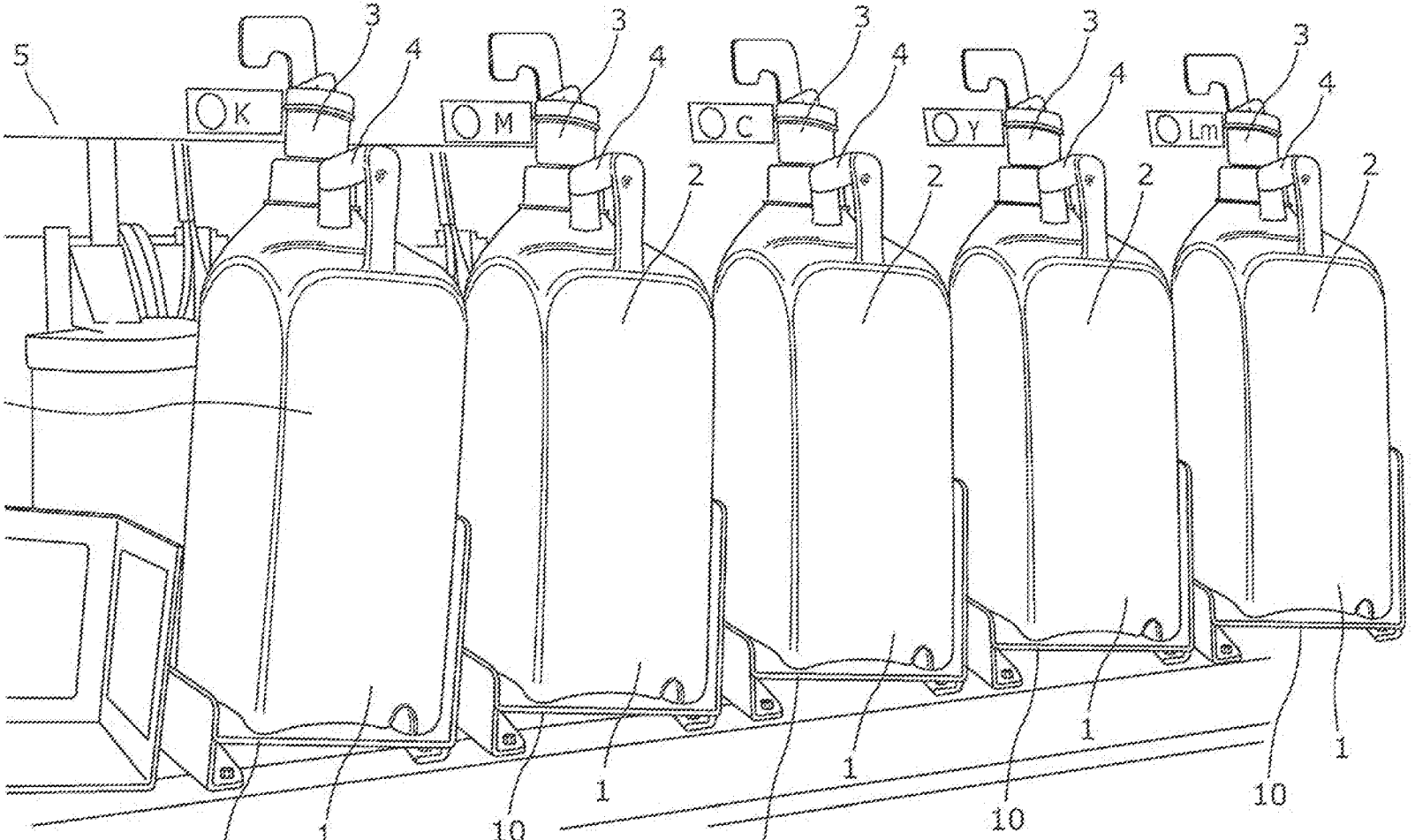
FIG. 3 shows a set of printing agent containers connected to a printer.

As mentioned above, the protrusion 231 acts as a positioning member to avoid that a collision or unwanted movements on the container 1 cause the tube 31 to move to a position other than a predefined feed region. In the example of FIG. 3, the feed region comprises a section of the receptacle wherein the maximum amount of fluid may be transferred through the output 30. Also, often containers 1 are installed tilted over a platform so that the printing agent is moved to a specific section of the receptacle 2 wherein the feed region may be located. In the example of FIG. 2, the protrusion is located in the bottom surface, but any protrusion towards the inner volume in the vicinity of the bottom surface will have the same effect.

In the example of FIG. 3, the feed region is located between the protrusion 231 and at least one of the side walls.

In this configuration the protrusion 231 helps maintain the tube 31 in its position together with the bending force on the tube. The protrusion 231 prevents movements of the tube in the direction between the side faces 21 and the bending force prevents the tube 31 from moving in the direction between the frontal faces.

The protrusion may be integrally molded to the receptacle, as in the case of FIG. 2, or may be attached to the container by adhesives or any other fixing means.

The location of the protrusion 231 is preferably on the bottom surface and spaced-apart from at least one of the walls by a separation distance in the range of 1-3 times the diameter of the tube. The separation distance defining the feed region, that is, the region between the protrusion and at least one of the side walls.

The protrusion 231 may have a different shapes depending on the application. In the example of FIGS. 1-3 the protrusion 231 has a substantially cylindrical shape, nonetheless, other shapes are envisaged such as an L-shape or an arch to also contact one of the sidewalls and increase the positioning effect on the tube 31.

The manufacturing of the receptacle may be made by molding. In an example, the receptacle is manufactured by blow-molding and the receptacle is made of a thermoplastic material, for example, high-modulus high-density polyethylene (HM-HDP).

The cap 3 may include an agent outlet 30 arranged to be fluidically connected to a tube on its inner part and to an adaptor or printer on its outer part as to supply the agent of the inner volume of the receptacle 2 to a printer. The outlet 30 may protrude from the cap 3, for example in an upwards direction and in an installed and upright condition of the container 1. The cap 3 may include further interface features such as at least one of a chip, an adaptor interconnect latch feature, a key lock out feature and a vent device. For example, these interface features may interface with connector or printer elements at least at some point during usage. In an example, some of the interface features protrude from the cap 3.

In a further example, the vent device may provide for an ambient air opening in the receptacle 2 during usage. The vent device may be closed before usage and is arranged to break open when beginning usage, for example by connecting a connector. The chip can include a memory or integrated circuit or microprocessor and is designed for interconnection with a printer or adaptor connector for one- or two-way data or signal exchange. In one example, the chip is designed to interconnect with printer electrodes, triggering a signal in the printer that the container 1 has been connected and the signal may also indicate a property of the agent, for example, the agent's color, level or type.

FIG. 3 shows an example of a printer 5 wherein several containers 1 are installed. It is noted that containers 1 may be installed over platform 10 wherein such platform is inclined as to tilt the container 1 towards the feed region to optimize the amount of agent that may be withdrawn from the container 1.

In the example of FIG. 3 a five container arrangement is shown but the same principle can be applied to other printing arrangements.

In essence, it is disclosed a printing agent container comprising:

a receptacle having at least one side wall and a bottom surface defining an internal volume, a cap on a top surface of the receptacle, and a tube connected to the cap and defining a fluid connection between the internal volume and the cap, wherein the receptacle may comprise a protrusion that is provided, at least partially, in the bottom surface, and that extends into the internal volume, defining a bottom feed region between the protrusion and a side wall and wherein the tube extends at least partially in the feed region.

In an example, the tube is at least partly flexible and may have a proximal end attached to the cap, a distal end in the internal volume and a length to enable the distal end to engage the bottom surface of the receptacle. In a further example, the length of the tube is dimensioned to enable a bend of the tube over the bottom surface.

In an example, the tube is at least partly flexible, and a distal end of the tube extends in the feed region and engages one of the protrusion and a proximal side wall that together define the feed region, to hold the distal end of the flexible tube in place so that agent flows into the tube in the feed region. Also, the receptacle may have four upright side walls connected to each other through four rounded corners wherein the protrusion is provided near one of the rounded corners and the tube's end extends near said corner.

In an example, the protrusion is integrally molded with the receptacle thereby forming a monolithic structure. In an example, this is done by manufacturing the receptacle using, e.g., blow molding.

The receptacle may be made of high-density thermoplastic material, e.g., high-density polyethylene.

In a further example, the cap may comprise an outlet for connection to a printer.

Regarding the type of agents, the agent may be ink and, therefore, the inner volume contains ink.

Furthermore, it is disclosed a method of manufacturing a printing agent container comprising:

providing a receptacle that defines an internal volume wherein the receptacle comprises a top surface, at least one side wall and a bottom surface, the receptacle further comprising a protrusion protruding into the internal volume; and attaching a cap to the receptacle wherein the cap comprises a tube attached on its proximal end to the cap;

wherein the attaching of the cap comprises locating the distal end of the tube in a feed region between the protrusion and the side wall.

In an example, providing the receptacle comprises blow molding the receptacle.

In another example, the distal end of the tube is installed to contact the bottom surface of the receptacle.

In a further example, the receptacle is made of a high-density thermoplastic material, for example, high-density polyethylene.

What is claimed is:

1. Printing agent container comprising:

a receptacle having at least one side wall and a bottom surface defining an internal volume, a cap on a top surface of the receptacle, and a tube connected to the cap and defining a fluid connection between the internal volume and the cap, wherein the receptacle comprises a protrusion that is provided, at least partially, in the bottom surface, and that extends into the internal volume, defining a bottom feed region between the protrusion and a side wall and wherein the tube extends at least partially in the feed region.

2. Printing agent container according to claim 1 wherein the tube is at least partly flexible and wherein the protrusion is separated from the side wall by a distance equal to one to three diameters of the tube.

3. Printing agent container according to claim 2 wherein the tube has a proximal end attached to the cap, a distal end in the internal volume and a length to enable the distal end to engage the bottom surface of the receptacle.

4. Printing agent container, according to claim 3 wherein the length of the tube is dimensioned to enable a bend of the tube over the bottom surface.

5. Printing agent container, according to claim 1, wherein the tube is at least partly flexible, and a distal end of the tube extends in the feed region and engages one of the protrusion and a proximal side wall that together define the feed region, to hold the distal end of the flexible tube in place so that agent flows into the tube in the feed region.

6. Printing agent container of claim 5, wherein the receptacle has four upright side walls connected to each other through four rounded corners wherein the protrusion is provided near one of the rounded corners and the tube's end extends near said corner.

7. Printing agent container, according to claim 5, wherein the protrusion is integrally molded with the receptacle.

8. Printing agent container, according to any of claim 5, wherein the receptacle is manufactured by blow molding.

9. Printing agent container, according to claim 8, wherein the receptacle is made of high-density polyethylene.

10. Printing agent container, according to claim 5, wherein the receptacle is made of high-density thermoplastic material.

11. Printing agent container, according to claim 1, wherein the cap comprises an outlet for connection to a printer.

12. Printing agent container, according to claim 1, wherein the agent is ink and the inner volume contains ink.

13. Printing agent container, according to claim 1, wherein the protrusion is separated from the side wall by a distance equal to one to three diameters of the tube.

14. Printing agent container, according to claim 1, wherein the protrusion is cylindrical.

15. Printing agent container, according to claim 1, wherein the feed region comprises a curved portion and the curved portion is between the side wall and the bottom surface.

16. Method of manufacturing a printing agent container comprising:

providing a receptacle that defines an internal volume wherein the receptacle comprises a top surface, at least one side wall and a bottom surface, the receptacle further comprising a protrusion protruding into the internal volume; and attaching a cap to the receptacle wherein the cap comprises a tube attached on its proximal end to the cap;

wherein the attaching of the cap comprises locating the distal end of the tube in a feed region between the protrusion and the side wall, wherein the feed region comprises a curved portion between the side wall and the bottom surface.

17. Method, according to claim 16, wherein providing the receptacle comprises blow molding the receptacle.

18. Method, according to claim 16, wherein the distal end of the tube is installed to contact the bottom surface of the receptacle.

19. Method, according to claim 16, wherein the receptacle is made of a high-density thermoplastic material.

20. Method, according to claim 16, wherein the protrusion is separated from the side wall by a distance equal to one to three diameters of the tube.

* * * * *